United States Patent [19]

Kooy et al.

[11] Patent Number: 4,775,766

[45] Date of Patent: Oct. 4, 1988

[54] TAPPED TRANSFORMER/SWITCH ASSEMBLY

[75] Inventors: Wayne J. Kooy, Galien; Kent H. Frye, Buchanan; both of Mich.; Paul F. Fidlin, South Bend, Ind.

[73] Assignee: Electro-Voice, Incorporated, Buchanan, Mich.

[21] Appl. No.: 38,732

[22] Filed: Apr. 15, 1987

[51] Int. Cl.[4] ..... G05F 3/00; H01H 19/58

[52] U.S. Cl. ..... 200/11 TC; 200/11 DA; 200/11 J; 323/340

[58] Field of Search ..... 200/11 D, 11 DA, 11 E, 200/11 EA, 11 J, 11 K, 11 TW, 11 TC; 307/104, 112, 125, 126, 139, 140, 154, 26, 28, 36, 38, 42, 17; 336/150; 323/328, 341, 345, 346, 340

[56] References Cited

U.S. PATENT DOCUMENTS

| | | | |
|---|---|---|---|
| 3,803,370 | 4/1974 | Garcia | 200/11 J |
| 3,831,125 | 8/1974 | Brundage | 200/11 TC X |
| 3,855,521 | 12/1974 | Kiuchi | 200/11 TC X |
| 4,232,207 | 11/1980 | Kuhl et al. | 200/11 DA X |
| 4,356,360 | 10/1982 | Volz | 200/11 J X |

*Primary Examiner*—J. R. Scott

*Attorney, Agent, or Firm*—Burmeister, York, Palmatier, Hamby & Jones

[57] ABSTRACT

A power selector assembly for a loudspeaker includes in one embodiment an audio transformer upon which a printed circuit board (PCB) is mounted via connector strips having pins for both securing the PCB to the transformer, and for individually electrically connecting foil contacts of the PCB to the multi-tapped primary and the secondary windings of the transformer. The transformer is mounted within a housing. An electrical wiper contact is resiliently mounted between the PCB and a knob retained in an access hole through the housing, for permitting the knob to be rotated for positioning the wiper contact to selectively electrically connect a foil terminal receiving an input signal to one of a plurality of contact foils of the PCB, for connecting the input signal to one of the taps of the primary winding associated with a desired power level. Other electrical connections on the printed circuit board provide for connecting a loudspeaker to the secondary winding. In another embodiment, only the secondary winding of the transformer is multitapped, and the power selector switching assembly is configured for permitting the knob to be rotated for selectively connecting one of the taps of the secondary winding to a load, for controlling the power applied to the load.

20 Claims, 4 Drawing Sheets

TAPPED TRANSFORMER/SWITCH ASSEMBLY

FIELD OF THE INVENTION

The field of the present invention relates broadly to variable transformers, and more specifically to selector apparatus including a transformer having multitapped primary or secondary windings, and a multiple position selector switch for either applying input power to the primary winding, or extracting output power from the secondary winding, between a common connection point and a selected one of the taps of the primary winding, or secondary winding, respectively, for obtaining a desired voltage from the secondary windings of the transformer from a predetermined alternating current input voltage.

BACKGROUND OF THE INVENTION

In many different applications where power is delivered from a source to a load, or a plurality of loads, it is necessary to match or tailor the output power applied to a particular load in order to obtain optimum performance. For example, in public address systems, audio power from an amplifier is delivered to a loudspeaker by first passing the audio signal through a power selector system, for selecting the actual power applied to the loudspeaker for a predetermined audio input signal. In such public address systems a typical power selector system may include a transformer having a multitapped primary winding, a secondary winding, and a multiple position switch for receiving the audio input signal and permitting it to be selectively applied to a given one of the taps of the primary winding, for selecting the output power applied to the load, in this example a public address loudspeaker. Such power selector systems in the prior art include a transformer having solder lugs connected to each one of the taps of the primary winding, for permitting electrical conductors to be handwired and soldered to the lugs of the transformer, and the other ends of the conductors to the contacts of a separate commercially available rotary switch, for example. The secondary winding of the transformer typically includes solder lugs for connecting the voice coil for the loudspeaker to the secondary windings. The transformer and switch are usually mounted in the same housing used for the loudspeaker, with the switch and transformer each requiring individual and separate mounting. Handwiring of the individual conductors between the transformer and the switch, and the separate mounting of the same in the speaker housing is time consuming, significantly adding to the cost of the public address system.

SUMMARY OF THE INVENTION

An object of the present invention is to provide an improved power selector system for applying an alternating current signal to a load.

Another object of the invention is to provide a unitary switch and transformer assembly for a power selector system, offering reduced assembly time and increased reliability.

Yet another object of the invention is to provide an improved power selector switching system for selectively controlling the power of an audio signal applied to a loudspeaker.

Another object of the invention is to provide apparatus for improving the method of assembling a power selector switch and multitapped transformer to provide a power selector system for applyuing an alternating current power to a load.

With these and other objects in mind, one embodiment of the present invention overcomes the problems in the prior art by providing a power selector system including a transformer having a multitapped primary winding, and a secondary winding for connection to a load, a plurality of electrically conductive pins electrically connected to the taps of the primary winding during assembly of the transformer, for providing mounting posts for a printed circuit board and electrical connection to individual foil segments arranged in a predetermined pattern on the top surface of the printed circuit board, whereby the printed circuit board conductor pattern provides contacts for one portion of a rotary switch, with wiper contact means being mounted centrally on the top of the printed circuit board for rotating in a manner to interconnect an input signal to a selected one of the taps of the primary winding of the transformer, and knob means captively mounted within a hole through a housing in a position for resiliently engaging the wiper contact means for selectively rotating the latter to a desired power selector position for applying a selected portion of the input signal power to the load connected to the secondary winding of the transformer, with the transformer being rigidly mounted within the housing behind the knob means. Certain of the individual electrically conductive segments of the printed circuit board provide terminal means for connecting the load and input signal to the power selector system. Indent means are provided between the knob means and the housing for providing a plurality of individual positively indented rotational positions for the knob, for selection of a desired wiper contact position for obtaining a desired output power level. Also, stop means are provided between the knob means and the housing for limiting the extent of clockwise and counterclockwise rotation of the knob means. In another embodiment, a multitapped secondary winding is employed with substantially the same switch configuration described above, for selection of a desired wiper contact position for selecting an associated tap of the secondary winding for obtaining a desired output power level to a load.

BRIEF DESCRIPTION OF THE DRAWINGS

In the drawings like items are indicated by the same reference designation, wherein.

DESCRIPTION OF THE PREFERRED EMBODIMENTS OF THE INVENTION

Figure 1:
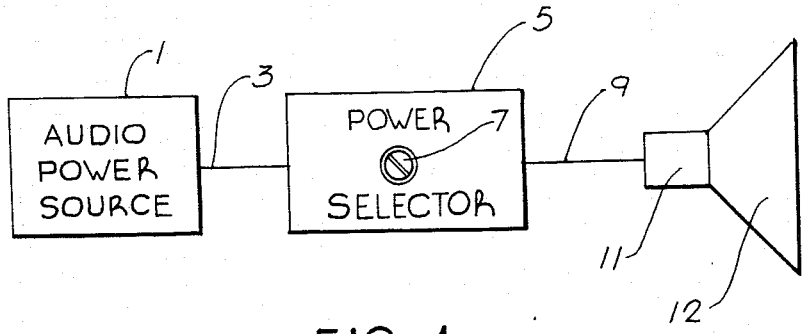
FIG. 1 is a block diagram of a typical public address system.

With reference to FIG. 1, in a typical public address system, an audio power source for amplifying audio signals from either a microphone or other source of audio signals such as a tape deck, is connected by a cable 3 to a power selector system 5 having a rotatable selector knob 7, for selecting a level of power to be connected via a cable 9 to a voice coil 11 of a loudspeaker 12. Although the present invention is described with reference to a power selector system 5 for use in a public address system, in this example, such an example is for purposes of explanation only and not meant to be limiting. The power selector system 5 of the present invention can be used for selectively changing the level of power of an input signal before connection of the signal to a load.

Figure 2:
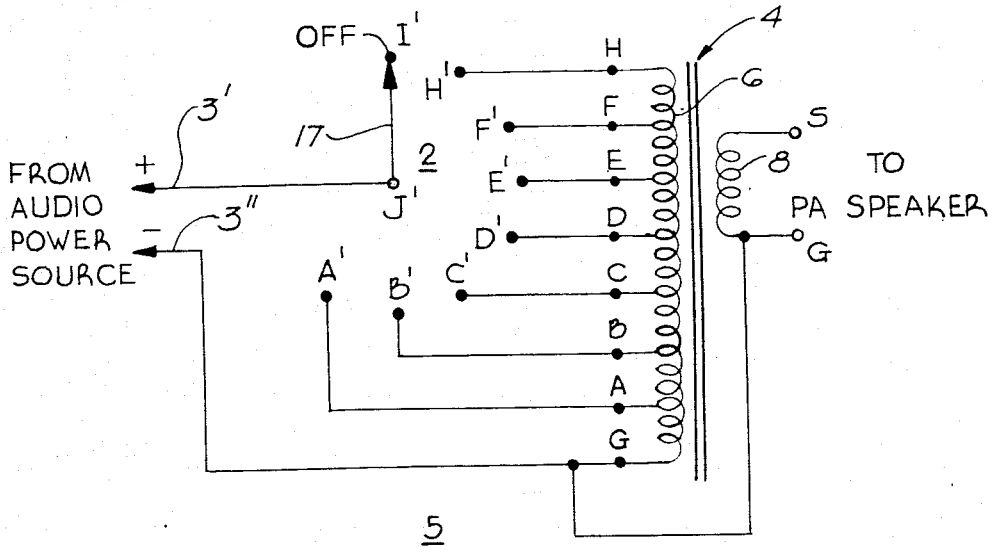
FIG. 2 is a circuit schematic diagram of one embodiment of the "power selector" of FIG. 1 including a mulitapped primary winding.

As shown in FIG. 2, in a first embodiment of the invention the power selector 5 includes an audio transformer 4, in this example, having a primary winding 6 with a plurality of taps A, B, C, D, E, F and H, and a secondary winding 8 connected to output terminals S and G. Note that tap H is connected tothe top of the primary winding 6, and output terminal S is connected to the top of secondary winding 8. A rotary switch 2 has a wiper arm contact J' connected to a "hot" input terminal 3' designated by a plus sign, and a plurality of contacts A', B', C', D', E', H', and I', the lattermost contact being in an off position for the switch. The wiper arm 17 of switch 2 can be selectively rotated to electrically connect wiper arm contact J' to any one of the switch contacts A' through F' and H', for selectively electrically connecting input conductor 3' to one of the A through F and H taps of the primary winding 6 of the transformer 4 for selecting a desired level of power to be supplied to a load, such as a public address speaker 12 connected across output terminals S and G. A second input conductor 3'' is electrically connected to one extreme end of the primary winding 6 via the bottom tap G, as shown, for providing an electrical common reference potential or ground point, in this example. Note that both the bottom leads of primary winding 6 and secondary winding 8 are connected to a common terminal G, in this example. In practice, these common terminals may or may not be electrically connected together. As previously mentioned, in the prior art, such a power selector arrangement typically involves a separate power transformer and rotary switch interconnected via handwiring, and requiring separate mounting of the individul components within a common housing, for example.

With reference to FIGS. 3 through 7, the present invention overcomes the disadvantages of prior such power selector assemblies 5, by providing a unitary transformer and switch assembly including a transformer 4 mounted within a housing 13, a pin connector 22 rigidly mounted on either side of the transformer windings 6, 8 (see FIG. 7), from which transformer/-printed circuit connector 22 pins 25 protrude, as shown. The pins or posts 25 are electrically connected to the taps A through H of primary winding 6, to the common G, and to the secondary winding 8 output line S. Pins 25 provide a means for both securing and making electrical connection to a printed circuit board 19 mounted on top of the pin connectors 22 and transformer 4, as shown.

Figure 3:
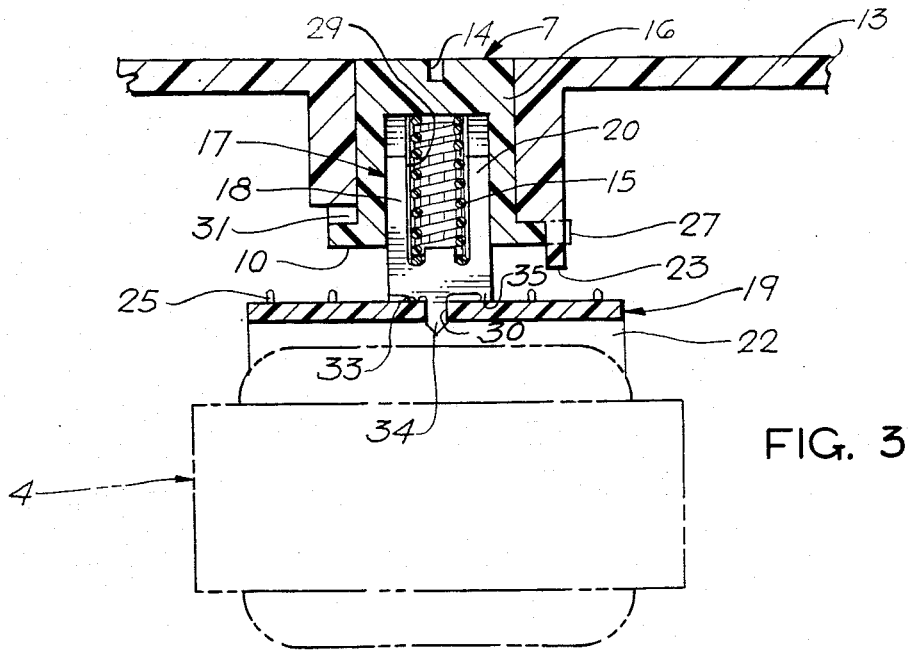
FIG. 3 is a cross-sectional diagram of a portion of one embodiment of the invention.
Figure 4A:
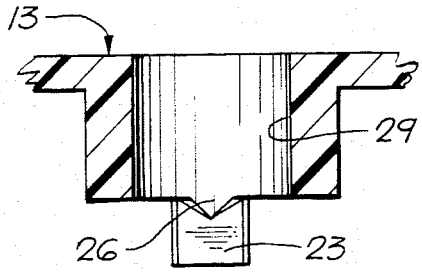
FIG. 4 is a cross-section of the housing of FIG. 3 rotated 90 degrees about an axis central to the axis hole of the housing.
Figure 4B:
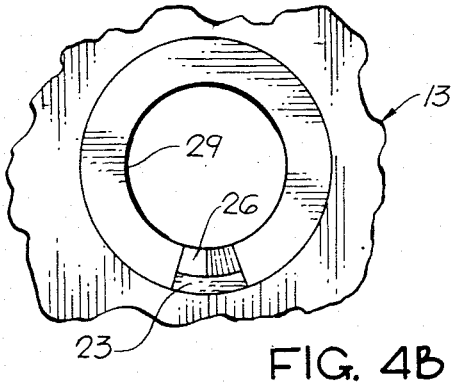

The selector knob 7 is captively mounted through a hole 16 via a flanged portion 10. A resilient biasing is provided by the combination of a wiper contact 17 and spring 15 mounted within an interior hole 29 of the knob 7, with the other end of the wiper contact 17 having a post 34 inserted through a centrally located hole 30 of printed circuit board 19, the spring 15 also causing ring wiper surface 33 and segment wiper surface 35 (see FIG. 6) of the wiper contact 17 to be resiliently biased against the foil portions 41 of the printed circuit board 19. In this example, the wiper contact 17 is fabricated from electrically conductive material. Note that the wiper contact 17 includes two spaced apart prongs 18, 20, between which a short stud 21 is located for retaining an end of spring 15. The prongs 18, 20 are inserted into the slot portions 30 of hole 29 for retaining wiper 17 and spring 15, as shown. A slot 14 is provided in the top of the knob 7 for permitting insertion of a screwdriver or coin, for example, to rotate the knob 7 for selecting a particular power level, as will be described. A housing stop 23 is positioned as shown in FIG. 3 for contacting knob stops 27 of knob 7 (see FIGS. 4A, 4B, 5A, 5B and 7), to limit the clockwise and counterclockwise rotation of the knob 7.

Figure 5A:
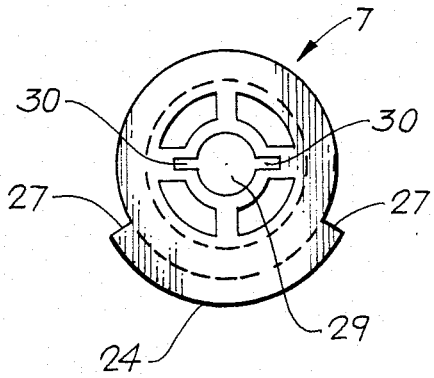
FIGS. 5A and 5B are views of the bottom and side of a selector knob of one embodiment of the invention.
Figure 5B:
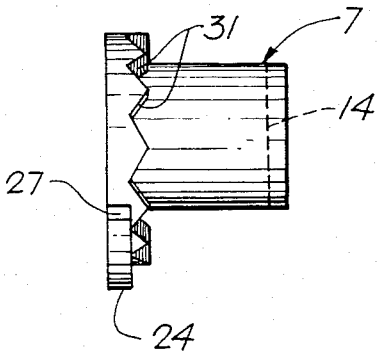

As shown in FIG. 5A, the knob stops 27 are formed at the ends of the truncated semicircular outermost flange member 24 of knob 7. Also, integral mounted ramps 26 (see FIG. 4) are provided on the housing 13, as shown, for engaging knob ramps 31 (see FIG. 5B), whereby the ramps 26 and 31 engage one another for forming a detent for the rotation of knob 7 to different positions for selecting a given power level. The spring 15 provides the necessary force for obtaining appropriate detent action, and as previously mentioned, the force necessary for maintaining proper contact pressure between the wiper contact 17 and the foil or electrically conductive segments 41 (see FIGS. 6 and 7) for obtaining proper switching action. Note that the segments 41 could be provided by other than foil. For example, the segments 41 could be fabricated from copper sheets laminated to a suitable substrate, and so forth.

Figures 6, 7:
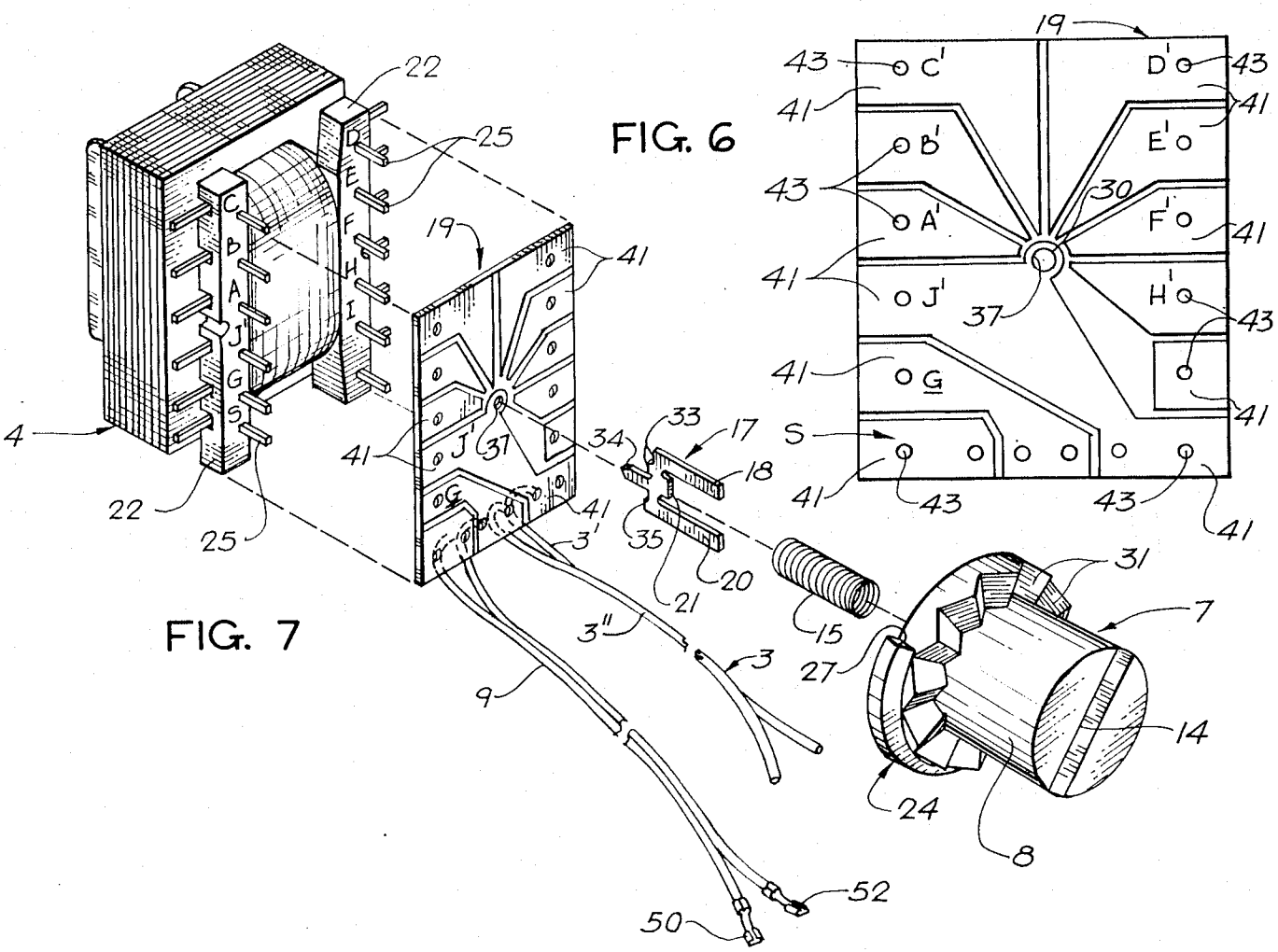
FIG. 6 shows a plane view of a printed circuit board of one embodiment of the invention.
FIG. 7 shows an exploded pictorial assembly diagram of one embodiment of the invention.

With reference to FIGS. 6 and 7, the printed circuit board 19 includes a plurality of holes 43 for receiving various ones of the pins 25 of transformer 4. Conductive foil segments 41, in this example, are laid out on the printed circuit board in a predetermined pattern as shown. The contact J' shown in FIG. 2 for connection to the wiper arm 17 is indicated as shown by the J' designation on the foil 41 on the PC board 19 (see FIGS. 6 and 7). This particular foil includes a foil section 37 formed around a centrally located hole 30 through the printed circuit board 19. With reference to FIGS. 3 and 7 in particular, the one embodiment of the power selector 5 of the present invention is assembled by first orienting the printed circuit 19 as shown and pushing it onto the pins 25 via holes 43 until it is flush with the top surface of the connectors 22. Next the pins are soldered to the foil segments 41 for securing the printed circuit board 19 to the transformer 4, and for ensuring positive electrical connection between the pin 25 and the foil segments 41. The voice coil leads 9 and input leads 3 can be connected to the printed circuit board appropriate foil segments 41 via printed circuit card connectors (not shown) or by soldering the respective leads to holes in the foil segments designated S, G, and J', as shown, before installing the printed circuit board 19 on transformer 4, previously mentioned. Next the wiper contact 17 is inserted via its post 34 into the central hole 30 of the printed circuit board 19, and the knob 7 carrying the spring 15 is installed over the wiper contact 17. This assembly is then positioned within the housing 13 as shown in FIG. 3, and the transformer 4 is secured to the housing 13 by appropriate means, such as a mounting bracket (not shown). Note that as shown in FIG. 7, spade lugs 50 and 52 can be provided at the other ends of the voice coil leads 9 to permit these leads to be easily connected to the voice coil of a loudspeaker 12, in this example.

In operation, the output signal from an audio power source 1 is coupled via the cable 3 to the J' designated foil of the printed circuit board 19, and the knob 7 is rotated via a screwdriver to rotate the wiper contact 17 to a position for interconnecting via the ring wiper 33 the input signal from the foil J' to a selected one of the foils 41 designated A' through F' and H', for selecting an appropriate or desired power level for driving the loudspeaker 12. The previously mentioned spring 15 provides resilient biasing for obtaining appropriate indexing via the ramps 31 of knob 7 and ramps 26 of the housing 13, for locking the power selector knob 7 in the desired position, and also provides appropriate pressure for obtaining good electrical contact and wiping action between the ring wiper 33 and foil ring 37, and between the segment wiper 35 and the selectable foils previously mentioned. The stop 23 on the housing and the cooperative stop portion 27 of the knob 7 prevent rotation of the knob to a clockwise or counterclockwise extreme position that would cause the wiper contact to connect the input lead to other than the selectable ones of the foils A'-F', and H'.

An engineering prototype of the present invention was built. Laboratory measurements for the prototype system provided the results shown in Table 1 below for a 1.0 Khz audio signal:

TABLE 1

| PRIMARY CONNECTION | PRIMARY VOLTAGE | PRIMARY VOLT-AMPERES | 1 khz UNLOADED SECONDARY VOLTAGE (5%) |
|---|---|---|---|
| A | 25 | 5.0 | 6.32 |
| B | 25 | 2.5 | 4.47 |
| C | 70.7 | 10.0 | 8.94 |
| D | 70.7 | 5.0 | 6.32 |
| E | 70.7 | 5.0 | 6.32 |
| F | 70.7 | 1.25 | 3.16 |
| H | 70.7 | 0.62 | 2.23 |

In practical systems, the turns ratio between the primary winding 6 sections associated with taps A-F, H, and the secondary winding 8 will determine the level of the output voltage across terminates S and G for each position of knob 7.

Figure 8:
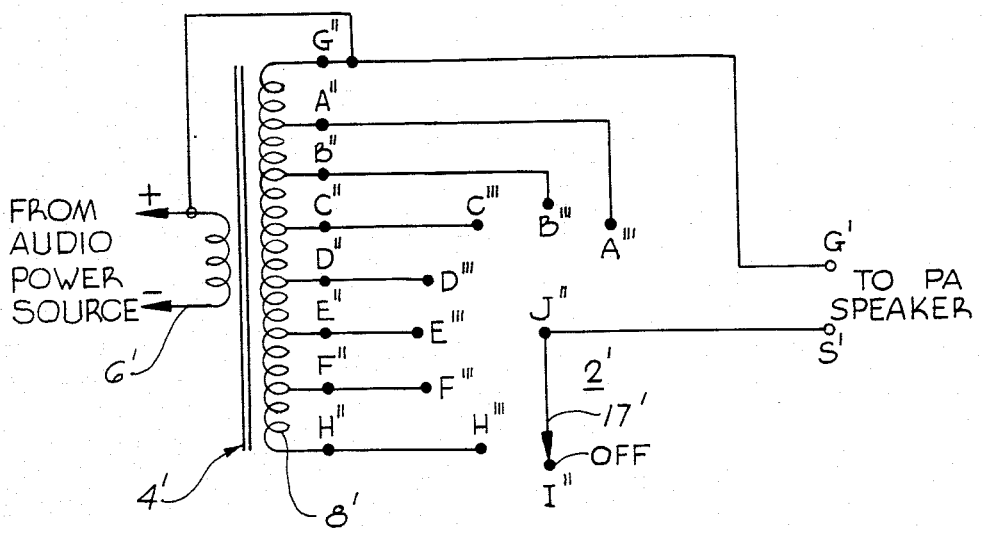
FIG. 8 is a circuit schematic diagram of another embodiment of the "power selector" of FIG. 1.

As shown in FIG. 8, in a second embodiment of the invention, the power selector 5 includes an audio transformer 4', in this example, having a primary winding 6' and a secondary winding 8' with a plurality of taps A'', B'', C'', D'', E'', F'', G'' and H'' connected to output terminals S' and G'. Note that tap G'' is connected to the top of secondary winding 8, and that the + lead of primary winding 6' is associated with the top of this winding. A rotary switch 2' has a wiper arm contact J'' connected to a "hot" output terminal S', and a plurality of contacts A''', B''', C''', D''', E''', F''', H''', and I''', the lattermost contact being in an off position for the switch. The wiper arm 17' of switch 2' can be selectively rotated to electrically connect wiper arm contact J'' to any one of the switch contacts A''' through F''' and H''', for selectively electrically connecting output terminal S' to one of the A'' through F'' and H'' taps of the secondary winding 8' of the transformer 4' for selecting a desired level of power to be supplied to a load, such as a public address speaker 12 connected across output terminals S' and G'. Note that both the top leads of primary winding 6' and secondary winding 8' are connected to a common terminal G', in this example. In practice, these common terminals may or may not be electrically connected together. Relative to the first embodiment of the invention, other than using a multitapped secondary winding 8' instead of a multitapped primary winding 6, the second embodiment of the invention is similar.

In the second embodiment of the invention, successive clockwise rotation of wiper contact 17' by an associated power selector knob 7, will cause increasingly lower level ones of the secondary taps "A" through "F" and "H" to be engaged, for causing increasingly lower level audio output signals to be coupled to terminals G' and S' for connection to a speaker.

Although particular embodiments of the present invention have been shown for purposes of illustration for use in a public address system, such illustration is not meant to be limiting, in that the present power selector invention has many other applications as would be covered by the scope and spirit of the appended claims.

What is claimed is:

1. A power selector device, comprising:

housing means for enclosing said power selector device, said housing means having an access hole;

a transformer including a multitapped primary winding, and a secondary winding;

printed circuit board means including a plurality of electrically conductive foil means arranged in a pattern upon a substrate for providing switch contacts, and electrical connection paths between both a terminal for a signal source and said primary winding, and between a load and said secondary winding;

mounting means for both rigidly mounting said printed circuit board means upon said transformer, and electrically connecting said multitapped primary winding and said secondary winding to said plurality of electrically conductive foil means;

wiper contact means rotatably mounted upon said printed circuit board means, for selectively electrically connecting said signal source to a tap of said primary winding by providing an electrical conduction path between the associated two of said plurality of electrically conductive foil means; and knob means for resiliently and captively retaining said wiper contact means between said access hole of said housing and said printed circuit board, said knob means being rotatable for rotating said wiper contact means to select a desired level of signal power for connection to said load.

2. The power selector of claim 1, wherein said mounting means includes:

first and second connector strips mounted on either side of one face of said transformer with a plurality of electrically conductive posts protruding outward from said first and second connector strips perpendicular to the face of said transformer, said plurality of posts being electrically connected to individual ones of a plurality of taps of said primary winding, and to the ends of said secondary winding, respectively; and said printed circuit board means further including means for both rigidly mounting said printed circuit board means on top of said first and second connector strips, and electrically connecting said plurality of conductive foil means to individual ones of said electrically conductive posts, respectively.

3. The power selector of claim 2, wherein said means for both mounting said printed circuit board upon said first and second connector strips, and electrically connecting said plurality of conductive foil means to individual ones of said electrically conductive posts, respectively, includes a plurality of holes through given ones of said plurality of conductive foil means and underlying substrate, for receiving said electrically conductive posts, respectively, whereby the latter are rigidly and electrically connected to their associated foil means.

4. The power selector of claim 1, wherein one of said plurality of electrically conductive foil means includes a section centrally located on said printed circuit board and shaped in the form of a foil ring about a ring hole through said printed circuit board, and another section for receiving a signal; and wherein said wiper contact means includes:

a centrally located post at its extreme lower end for insertion through the ring hole of said printed circuit board;

a midsection having a radial inwardly located first contact surface juxtaposed to one side of said post for wiping and electrically contacting said foil ring, and a radial outwardly located second contact surface juxtaposed to the other side of said post and in the same horizontal plane as said first contact surface, for individually wiping and electrically contacting the ones of said plurality of electrically conductive foil means associated with said taps of said primary winding, respectively, said first and second contact surfaces being electrically interconnected; and an upper end portion adapted for insertion into a central hole in the bottom of said knob means, whereby as said knob means is rotated, said first and second contact surfaces provide an electrical conduction path bridging the aforesaid individual ones of said plurality of electrical conductive foil means and said foil ring.

5. The power selector of claim 4, wherein said wiper contact means further includes said upper end portion having a pair of spaced apart prongs between which a short stud is located immediately above said post; and wherein said knob means includes a pair of slots at opposite sides of the hole in the bottom of said knob means for receiving said pair of prongs, and a spring centrally located in the hole with one end engaging said short stud of said wiper contact means between said prongs, for providing the resilient biasing for said wiper contact means.

6. The power selector device of claim 1, further including stop means for limiting the clockwise and counterclockwise rotation of said knob means.

7. The power selector device of claim 6, wherein said stop means includes:

said knob including a lowermost circumferential flange truncated into an arc-like section providing first and second radially directed stop surfaces as its ends, the number of degrees of said arc-like section determining the limits of clockwise and counterclockwise rotation of said knob means; and said housing means including a downwardly projecting stud intersecting the path of travel of said first and second stop surfaces of said knob means for preventing rotation of said knob means between said first and second stop surfaces in clockwise or counterclockwise rotation of said knob means, respectively.

8. The power selector device of claim 1, further including detent means for detenting the rotation of said knob means to lock into any one of a plurality of predetermined rotational positions, for selecting different power settings for said device.

9. The power selector device of claim 1, wherein said detent means includes:

a downwardly directed first ramp-like projection from a circumferential flange of said access hole of said housing means;

a plurality of upwardly directed second ramp-like projections from a lower circumferential flange of said knob means, for interacting with said first ramp-like projection from said flange of said access hole, for providing positive detenting of said knob means at each selectable power level position thereof.

10. A power selector apparatus, comprising:

a housing having an access hole;

an AC transformer including a primary winding with a plurality of taps, a secondary winding, a core, a pair of pin connector strips mounted on either side of one face of the transformer, with a plurality of electrically conductive pins protruding outward from each strip perpendicular to the face of said transformer, a first portion of said pins being electrically connected to individual ones of the taps of said primary winding, respectively, and two of said pins being electrically connected individually to one and the other ends of said secondary winding;

a printed circuit board including a plurality of individual electrically conductive segment means arranged in a predetermined pattern on said printed circuit board, for providing switch contacts, and electrical terminals for connection to a load and a signal source, respectively, and means for both rigidly mounting said printed circuit board on top of said pin connectors, and electrically connecting said plurality of conductive segment means to individual ones of said electrically conductive pins, respectively; and selector means resiliently and captively mounted between said access hole of said housing and said printed circuit board, for selectively electrically connecting a given one of said conductive segments connected to said signal source to one of said conductive segments connected to said signal source to one of said conductive segments connected to a particular tap of said primary winding, for controlling the level of signal power applied to a load connected across said secondary winding.

11. A power selector device, comprising:

housing means for enclosing said power selector device, said housing means having an access hole;

a source of reference potential;

a transformer including a primary winding, and a multitapped secondary winding;

printed circuit board means including a plurality of electrically conductive means arranged in a pattern upon a substrate for providing switch contacts, and electrical connection paths between a plurality of terminals for both a signal source and said primary winding, and between a load and said secondary winding, respectively;

mounting means for both rigidly mounting said printed circuit board means upon said transformer, and electrically connecting said multitapped secondary winding, and said primary winding to said plurality of electrically conductive means;

wiper contact means rotatably mounted upon said printed circuit board means, for selectively electrically connecting said load to a tap of said secondary winding by providing an electrical conduction path between the associated two of said plurality of electrically conductive means; and knob means for resiliently and captively retaining said wiper contact means between said access hole of said housing and said printed circuit board, said knob means being rotatable for rotating said wiper contact means to select a desired level of signal power for connection to said load.

12. The power selector of claim 11, wherein said mounting means includes:

first and second connector strips mounted on either side of one face of said transformer with a plurality of electrically conductive posts protruding outward from said first and second connector strips perpendicular to the face of said transformer, said plurality of posts being electrically connected to individual ones of a plurality of taps of said secondary winding, and to the ends of said primary winding, respectively; and said printed circuit board means further including means for both rigidly mounting said printed circuit board means on top of said first and second connector strips, and electrically connecting said plurality of conductive means to individual ones of said electrically conductive posts, respectively.

13. The power selector of claim 12, wherein said means for both mounting said printed circuit board upon said first and second connector strips, and electrically connecting said plurality of conductive means to individual ones of said electrically conductive posts, respectively, includes a plurality of holes through given ones of said plurality of conductive means and underlying substrate, for receiving said electrically conductive posts, respectively, whereby the latter are rigidly and electrically connected to their associated conductive means.

14. The power selector of claim 11, wherein one of said plurality of electrically conductive means includes a section centrally located on said printed circuit board and shaped in the form of a ring about a ring hole through said printed circuit board, and another section for outputting a signal; and wherein said wiper contact means includes:

a centrally located post at its extreme lower end for insertion through the ring hole of said printed circuit board;

a midsection having a radial inwardly located first contact surface juxtaposed to one side of said post for wiping and electrically contacting said ring, and a radial outwardly located second contact surface juxtaposed to the other side of said post and in the same horizontal plane as said first contact surface, for individually wiping and electrically contacting the ones of said plurality of electrically conductive means associated with a plurality of taps of said secondary winding, respectively, said first and second contact surfaces being electrically interconnected; and an upper end portion adapted for insertion into a central hole in the bottom of said knob means, whereby as said knob means is rotated, said first and second contact surfaces provide an electrical conduction path bridging the aforesaid individual ones of said plurality of electrical conductive means and said ring.

15. The power selector of claim 14, wherein said wiper contact means further includes said upper end portion having a pair of spaced apart prongs between which a short stud is located immediately above said post; and wherein said knob means includes a pair of slots at opposite sides of the hole in the bottom of said knob means for receiving said pair of prongs, and a spring centrally located in the hole with one end engaging said short stud of said wiper contact means between said prongs, for providing the resilient biasing for said wiper contact means.

16. The power selector device of claim 11, further including stop means for limiting the clockwise and counterclockwise rotation of said knob means.

17. The power selector device of claim 16, wherein said stop means includes:

said knob means including a lowermost circumferential flange truncated into an arc-like section providing first and second radially directed stop surfaces at its ends, the number of degrees of said arc-like section determining the limits of clockwise and counterclockwise rotation of said knob means; and said housing means including a downwardly projecting stud intersecting the path of travel of said first and second stop surfaces of said knob means for preventing rotation of said knob means between said first and second stop surfaces in clock-wise or counterclockwise rotation of said knob means, respectively.

18. The power selector device of claim 11, further including detent means for detenting the rotation of said knob means to lock into any one of a plurality of predetermined rotational positions, for selecting different power settings for said device.

19. The power selector device of claim 11, wherein said detent means includes:

a downwardly directed first ramp-like projection from a circumferential flange of said access hole of said housing means;

a plurality of upwardly directed second ramp-like projections from a lower circumferential flange of said knob means, for interacting with said first ramp-like projection from said flange of said access hole, for providing positive detenting of said knob means at each selectable power level position thereof.

20. A power selector apparatus, comprising:

a housing having an access hole;

an AC transformer including a secondary winding with a plurality of taps, a primary winding, a core, a pair of pin connector strips mounted on either side of one face of the transformer, with a plurality of electrically conductive pins protruding outward from each strip perpendicular to the face of said transformer, a first portion of said pins being electrically connected to individual ones of the taps of said secondary winding, respectively, and two of said pins being electrically connected individually to one and the other ends of said primary winding;

a printed circuit board including a plurality of individual electrically conductive segment means arranged in a predetermined pattern on said printed circuit board, for providing switch contacts, and electrical connection to a load and a signal source, respectively, and means for both rigidly mounting said printed circuit board on top of said pin connectors, and electrically connecting said plurality of conductive segment means to individual ones of said electrically conductive pins, respectively; and selector means resiliently and captively mounted between said access hole of said housing and said printed circuit board, for selectively electrically connecting a given one of said conductive segments connected to said load to one of said conductive segments connected to a particular tap of said secondary winding, for controlling the level of signal power applied to the load.

* * * * *

UNITED STATES PATENT AND TRADEMARK OFFICE

CERTIFICATE OF CORRECTION

PATENT NO. : 4,775,766
DATED : October 4, 1988
INVENTOR(S) : Wayne J. Kooy, Kent H. Frye and Paul F. Fidlin It is certified that error appears in the above-identified patent and that said Letters Patent are hereby corrected as shown below:

Column 2, line 1 delete "applyuing" and insert--applying--;
Column 3, line 24 delete "tothe" and insert--to the--;
Column 7, line 63 delete "as" and insert--at--.

Signed and Sealed this

Fourteenth Day of February, 1989

*Attest:*

*Attesting Officer*

DONALD J. QUIGG

*Commissioner of Patents and Trademarks*